United States Patent [19]

Conaway, Jr. et al.

[11] Patent Number: 4,573,265

[45] Date of Patent: Mar. 4, 1986

[54] METHOD OF MAKING ELECTRICAL CONTACTS

[75] Inventors: Donald E. Conaway, Jr., Attleboro; Ernest M. Jost, Plainville, both of Mass.

[73] Assignee: Checon Corporation, Attleboro, Mass.

[21] Appl. No.: 590,631

[22] Filed: Mar. 19, 1984

[51] Int. Cl.[4] ..... H01R 43/02

[52] U.S. Cl. ..... 29/879; 29/827; 29/882

[58] Field of Search ..... 29/883, 889, 520, 882, 29/827, 879

[56] References Cited

U.S. PATENT DOCUMENTS

| | | | |
|---|---|---|---|
| 1,105,489 | 7/1914 | Clement | 29/882 X |
| 1,132,094 | 3/1915 | Hosford . | |
| 2,127,648 | 8/1938 | Mehlhouse . | |
| 2,571,040 | 10/1951 | Juvinall et al. | 29/884 X |
| 2,646,613 | 7/1953 | Enzler | 29/520 X |
| 3,559,285 | 2/1971 | Kauffman | 29/827 |
| 4,183,611 | 1/1980 | Casciotti . | |
| 4,259,557 | 3/1981 | Takano | 29/882 X |

*Primary Examiner*—Mark Rosenbaum
*Assistant Examiner*—Carl J. Arbes

[57] ABSTRACT

Method of making electrical contacts by providing a continuous clad strip having a strip of contact material bonded to a base metal contact blade strip, removing contact material at spaced intervals from the strip, and severing the base metal strip in the intervals to form individual contacts in which the contact element is spaced inwardly from the margins of the contact blade.

6 Claims, 6 Drawing Figures

METHOD OF MAKING ELECTRICAL CONTACTS

This invention relates to a method of making electrical contacts of the type having a contact element bonded to a base metal contact blade.

In the past, such electrical contacts have been made by bonding individual contact elements to individual base metal blades as described for example in Hosford U.S. Pat. No. 1,132,094. This procedure has the advantage of making it possible to position the contact element in any desired location on the contact blade and to change its size independently of the size of the contact blade, thus making it possible to vary the electrical characteristics of the contact element independently of the heat sink characteristics of the contact as a whole, but it suffers from the necessity for precision in positioning and bonding together the individual contact elements and contact blade elements and for individual testing of each completed contact, requiring complex and expensive machinery. Such individualized operations are difficult to carry out on a consistent and uniform basis to obtain dependable results, in contrast to continuous bonding under steady state conditions as practiced in the present invention. Electrical contacts have also been made by bonding a continuous strip of contact material to a continuous strip of base metal to form a continuous clad strip, then cutting the clad strip into individual electrical contacts, as described for example in Mehlhouse U.S. Pat. No. 2,127,648 or in Casciotti et al. U.S. Pat. No. 4,183,611. This process has been widely used because of its simplicity and ease of testing and is referred to as the cladding, overlay, "Raislay" or toplay process. However, it has the disadvantage that the margins of the individual contact element coincide with the margins of the base metal contact blade where they are cut simultaneously; as a result, there is less heat sink area or mass available per unit of contact material in products made by the cladding method as contrasted to products made by individualized bonding of the Hosford patent.

The present invention contemplates a method of making an electrical contact which comprises providing a clad strip comprising a base metal contact blade in continuous strip form having bonded thereto a layer of contact material in continous strip form coextensive in length with the base metal strip and spaced inwardly from the longitudinal margins thereof, removing the contact material from said clad strip at spaced intervals along said strip, and severing said base metal strip in said intervals to form individual contacts having an element of contact material bonded to said base metal and spaced inwardly from the margins thereof.

Figure 1:
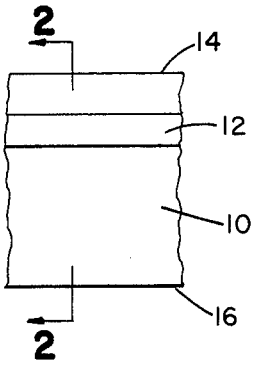
FIG. 1 is a plan view partly broken away showing the clad strip of the first step in the process of the present invention.
Figure 2:
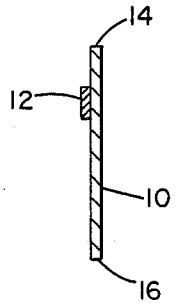
FIG. 2 is a view in section along line 2—2 of FIG. 1.

As appears from the drawing, the first step of the process of the invention comprises providing a continuous strip 10 of a base metal such as copper, brass, or other conventional electroconductive metal or alloy having the desired physical properties of a contact blade, to which is bonded a layer of contact material 12 in continuous strip form coextensive in length with strip 10 and spaced inwardly from the longitudinal margins 14, 16 of strip 10; strips 10 and 12 together form a clad strip. The clad strip (also termed in the art an overlay, "Raislay", or toplay) may be formed in any conventional manner, preferably by liquid phase bonding such as continuous brazing or solid phase bonding (roll bonding or cladding) of strip 12 to strip 10. Strip 12 may be made of any of the usual materials commonly employed for electrical contacts such as gold, palladium, platinum or the like, but preferably is silver or a silver-based contact material such as silver-cadmium oxide material. The clad strip can readily be subjected to continuous testing for quality of the bond between strips 10 and 12.

Figure 3:
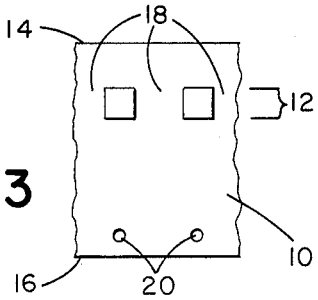
FIG. 3 is a view corresponding to that of FIG. 1 following the removal of contact material at spaced intervals from the clad strip of FIG. 1.
Figure 4:
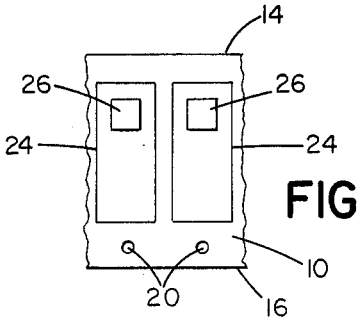
FIG. 4 is a view corresponding to that of FIGS. 1 and 3 showing the clad strip after the step of severing the finished contacts therefrom.

The clad strip of FIG. 1 is then subjected to a skiving or milling operation to remove strip 12 at spaced intervals 18 along its length leaving base metal strip 10 essentially unchanged, as shown in FIG. 3. In a preferred embodiment, pilot holes 20, 20 in strip 10 are also provided in advance of or simultaneously with the skiving or milling operation in order to serve as index means for the next step of the process, in which the strip 10 is severed in the intervals 18, 18, for example by a conventional stamping operation, and simultaneously perforated at 22 to form individual contacts 24. Strip 10 after the severing operation is shown in FIG. 4. This strip may readily be recovered for reuse in the usual manner. In addition, the contact material removed during the skiving or milling step may also be separately recovered for refining and reuse if desired.

Figure 5:
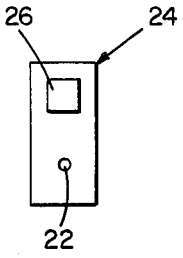
FIG. 5 is a plan view showing a finished electrical contact.

The finished electrical contact 24, shown in FIG. 5, comprises an individual contact element 26 having all of its margins spaced from all of the margins of the blade. Consequently, the finished contact has its heat sink requirement decoupled from the electrical and anti-erosion properties required in the contact material itself, providing maximum utility at reduced cost.

Figure 6:
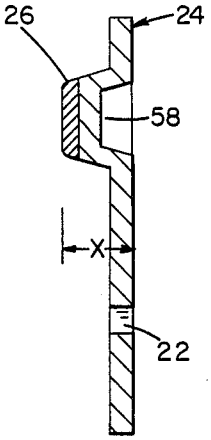
FIG. 6 is a view in cross-section showing an alternative form of finished electrical contact in which the product is embossed in the area of the contact.

In the alternative form of finished electrical contact shown in FIG. 6, the product shown in FIG. 5 is subjected to an embossing step at 58 in the area of contact material 26 to shape the surface of contact 26 to a desired generally spherical configuration. Such an embossing step makes it possible to control the operating dimension "X" of the finished contact independently of the thickness of contact material 12 or 26 to facilitate retrofitting of contacts and also facilitates smoothing of the edges and corners of contact 26 so as to minimize arcing and restrike potential of the product.

What is claimed is:

1. The method of making an electrical contact which comprises providing a clad strip comprising a base metal contact blade in continuous strip form having bonded thereto a layer of contact material in continuous strip form coextensive in length with said base metal strip and spaced inwardly from the longitudinal margins thereof, removing said contact material from said clad strip at spaced intervals along said strip, and severing said base metal strip in said intervals to form individual contacts each having lateral margins in addition to said longitudinal margins and having an element of contact material bonded to said base metal and spaced inwardly from all of the margins thereof.

2. The method as claimed in claim 1 in which said base metal comprises copper or copper alloy.

3. The method as claimed in claim 1 in which said contact material comprises silver or silver-cadmium oxide material.

4. The method as claimed in claim 2 in which said contact material comprises silver or silver-cadmium oxide material.

5. The method as claimed in claim 1 comprising in addition the step of providing said clad strip, before or during said removal step, with indexing means for indexing said severing step with said removal step.

6. The method as claimed in claim 5 including the additional step of embossing said contacts in the area of said contact material.

* * * * *